United States Patent [19]

Rae

[11] 4,213,531

[45] Jul. 22, 1980

[54] CARD WITH REMOVABLE THREE DIMENSIONAL FIGURINE

[76] Inventor: Donald A. Rae, P.O. Box 51, Jenkintown, Pa. 19046

[21] Appl. No.: 885,394

[22] Filed: Mar. 10, 1978

Related U.S. Application Data

[63] Continuation-in-part of Ser. No. 852,801, Nov. 18, 1977.

[51] Int. Cl.[2] ..... B65D 73/00; B65D 85/00

[52] U.S. Cl. ..... 206/463; 206/45.33; 206/216

[58] Field of Search ..... 206/471, 461, 462, 463, 206/486, 485, 216, 45.31, 800, 813, 45.33, 103, 489

[56] References Cited

U.S. PATENT DOCUMENTS

| | | | |
|---|---|---|---|
| 2,118,634 | 5/1938 | Williams | 206/103 |
| 2,642,988 | 6/1953 | Freeman | 206/45.31 |
| 2,974,782 | 3/1961 | Walters | 206/45.31 |
| 3,540,583 | 11/1970 | Tomlinson | 206/489 |
| 3,698,551 | 10/1972 | Tomlinson | 206/813 |
| 4,006,818 | 2/1977 | Wannyn | 206/486 |

FOREIGN PATENT DOCUMENTS

| | | | |
|---|---|---|---|
| 1166872 | 6/1958 | France | 206/463 |

*Primary Examiner*—William T. Dixson, Jr.
*Attorney, Agent, or Firm*—Weiser, Stapler & Spivak

[57] ABSTRACT

A card having a shaped, cut way area adapted to frictionally engage a removable, three dimensional figurine. The figurines may be fabricated of plastic and should be suitably configured to be frictionally held within the card. The remaining areas of the card are preferably flat and can be imprinted with descriptive matter relating to the figurine, or the like. Removable engagement of the figurine within the card permits the figurine to be used optionally as a toy separate from the card or as a three dimensional illustration relating to the matter printed on the card.

7 Claims, 3 Drawing Figures

CARD WITH REMOVABLE THREE DIMENSIONAL FIGURINE

RELATED APPLICATION

This application is a continuation-in-part of my copending application Ser. No. 852,801 filed Nov. 18, 1977.

BACKGROUND OF THE INVENTION

This invention relates generally to the field of illustrated cards, often referred to as trading cards or "baseball cards," and more particularly relates to a card designed to removably engage a three dimensional figurine within a cut out space configured as a silhouette of the three dimensional figurine being contained therein. The figurine serves preferably to complement the printed matter imprinted upon the card, and is also removable from the card to serve as a toy separate from the card.

For many years, cards containing printed matter relating to some area of leisure interest, generally sports, have been manufactured for sale, either alone or in connection with certain novelty items, such as candy or gum. Such cards have generally been designated trading cards or baseball cards, the ultimate purpose of those cards being to enhance purchases of candy or gum by collectors interested in collecting and trading to accumulate complete sets of given series.

Trading cards may relate to a wide variety of subject areas. However, their most common form generally relates to sports, usually depicting various popular sports personalities together with related statistics and personal information. Conventionally, such prior art cards contained a photograph of the personality on one side and printed material or statistics on the reverse side.

Such cards stimulate interest in the activity to which the card relates. As such they represent an important promotional device. The trading cards also serve as a teaching aid by supplying to the card collector various data concerning the related field of activity. This may involve either individual statistics or general, related rules or other informational material. The cards further serve as a hobby which is capable of stimulating interest in a particular area as an inexpensive, timely, leisure activity.

The copending patent application, Ser. No. 852,801, shows the use of three dimensional figurines in association with books, more particularly as part of the pages of the book. The same general structure is well adapted to individual cards. Such individual cards permit distribution of a particular item in larger quantities at lower cost. This is important where trading cards are involved since such cards generally are distributed with inexpensive novelty items or inexpensive candy or gum. Also, cards are directed at a different market than books, for example, children rather than adults. The cards therefore cannot have a cost which prohibits child participation.

The present invention provides a new form of trading card by replacing the familiar two dimensional photograph with a combination of a two dimensional card and a removable three dimensional figurine. In this manner, a collector may elect to either collect the cards with figurines attached or separate the two items and collect either or both as desired. It is anticipated that such three dimensional cards will heighten interest in trading cards since children, the most common collectors, are naturally attracted to small toy figurines. Such heightened interest will be beneficial since it stimulates healthy areas of interest having an important place in today's society.

SUMMARY OF THE INVENTION

This invention relates generally to the field of trading cards, and more particularly to a card designed to removably engage a three dimensional figurine within the confines of a cut out area which is closely configured to the shape of the particular figurine involved. The remaining, planar areas of the card are well suited to be imprinted with subject matter relating to the figurine or the field of interest to which it pertains. The figurines therefore serve a dual function, namely as three dimensional illustrations which complement the printed material, and additionally as free standing toys which may be utilized completely separate from the card.

The card itself is similar in nature to conventional trading cards of known configuration. Such cards may be fabricated of cardboard or sheet foam plastic and generally may be imprinted to contain statistics and personal data relating to a particular personality associated with a given field of interest.

Unlike conventional trading cards which contain a two dimensional illustration associated with the printed material such as a picture of the particular personality to which the card relates, in the present invention, the picture is replaced with a cut out area adapted to removably engage by frictional force at its perimeter a molded, three dimensional figurine.

Such figurines, which are preferably designed with a base or other construction to be self standing, are therefore easily removed from association with the card by pushing or punching the figurine from the space provided with a force sufficient to overcome the frictional engagement with the card. This separation enables use of the figurine as a toy separate from the card. The separated figurines may be collected, traded to obtain a complete set, or may simply be individually employed as toys, either with or without the corresponding printed material on the cards. Additionally, the cards may be traded and collected apart from the figurines, thereby allowing two independent collections to be assembled. The cards and figurines may also be traded in combination by reinserting the figurine into its corresponding cut out area in a corresponding card.

It is therefore an object of the present invention to provide an improved card with removable, three dimensional figurine.

It is another object of the present invention to provide a card which contains a removable, three dimensional figurine therein which acts to complement printed material on the card by serving as an illustration of that material.

It is another object of the present invention to provide a novel card, generally containing printed material, which is capable of removably, frictionally retaining a three dimensional figurine within a cut out area which is closely configured to the peripheral outline of the figurine.

It is another object of the present invention to provide a card with a removable three dimensional figurine which may be utilized as a toy upon removal from the card.

It is another object of the present invention to provide an improved trading card comprising a removable three dimensional object which may be collected as part of or separate from the card.

It is another object of the present invention to provide a trading card containing a removable, three dimensional figurine which is capable of being collected and traded, apart or in combination, to provide an interesting collecting hobby.

It is another object of the present invention to provide a novel card with removable, three dimensional figurine that is inexpensive in manufacture, simple in design and trouble free when in use.

These objects and others will become apparent to those skilled in the art from the following disclosure of the preferred embodiment of the invention taken in conjunction with the accompanying drawings wherein like reference characters refer to similar parts throughout the several views in which:

DESCRIPTION OF THE PREFERRED EMBODIMENT

Figure 1:
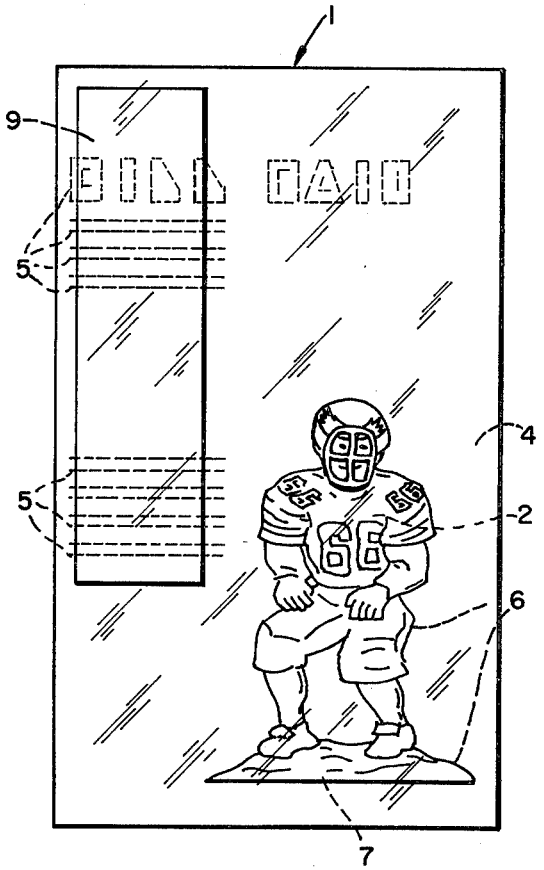
FIG. 1 is a front elevational view of a card containing a three dimensional figurine.

Although specific terms are used in the following description for the sake of clarity, these terms are intended to refer only to the particular structure of the invention selected for illustration in the drawings, and are not intended to define or limit the scope of the invention.

Figure 2:
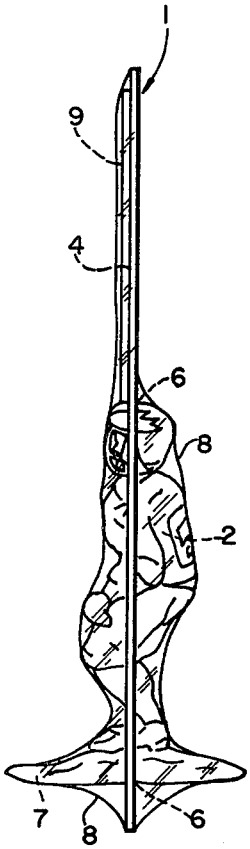
FIG. 2 is a side elevational view of the card of FIG. 1.

Referring now to the drawings, in FIGS. 1 and 2 there is illustrated a card 1 fitted with a molded three dimensional figurine 2 as the combination would generally appear during distribution and marketing.

The card 1 preferably is formed of heavy paper, cardboard, foam plastic, sheet plastic or other planar material which is capable of being inexpensively cut or otherwise formed using conventional machinery and techniques. The surface of the card preferably is flat or planar, however a textured surface could also be used. Ample space is provided for printed material 5 to be placed by imprinting or other known process at various locations on the front face 4 or rear face of the card 1.

Figure 3:
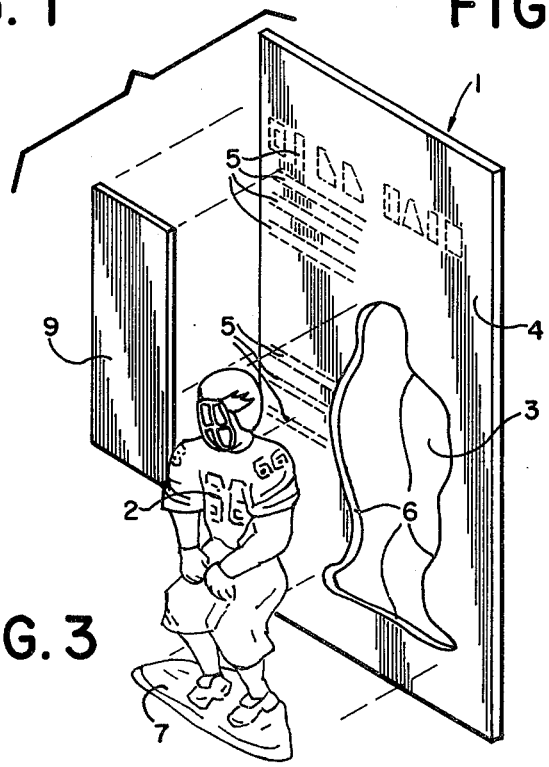
FIG. 3 is an exploded, isometric view of the card with the three dimensional figurine removed and showing the cut away area of the card in which the figurine was retained.

The card 1 is also provided with a cut out area 3 forming a configured silhouette 6 into which the figurine 2 is placed. The cut out area 3, as more clearly illustrated in FIG. 3, is closely configured in shape to the contours of the periphery of the figurine 2. However, it is not necessary that overall contact be made between the figurine 2 and the card 1 completely about the periphery of the figurine 2. Open, non-contacting surface areas may be provided about periphery of the figurine 2 if desired, so long as sufficient contact is maintained between the card and the figurine to assured frictional engagement.

The three dimensional figurine 2 generally depicts a personality or object known in a given area of interest in essence a three dimensional representation of the personality or object. Such a figurine 2 may be inexpensively formed of a moldable plastic, metal, wood, glass or other material capable of being manufactured using any of many known manufacturing techniques. Preferably, the figurine 2 would be formed of molded plastic due to low cost and availability of manufacturing facilities. The figurine 2 is perferably provided with an integral flat base 7 which is designed to support the figurine 2 in an upright position upon its removal from the card 1. However, this base structure is not necessary in all applications, if the free standing function is not required or desirable.

FIG. 3 illustrates the manner in which the figurine 2 is placed and retained in the card 1. As previously mentioned, the cut out area 3 defines a silhouette 6 which is closely configured to the contours of the periphery of the figurine 2. The figurine 2 is a press fit within the silhouette 6. The frictional forces between the periphery of the figurine 2 and the silhouette 6 are sufficient to hold a figurine 2 in removable engagement within the card 1.

To prevent soiling, damage, etc. during handling, shipment, and subsequent sale, the card 1 and figurine 2, after assembly, may be wrapped or otherwise protected in known fashion with a suitable wrapping material 8 such as cellophane sheet, plastic, paper, or the like. In this manner, the figurine 2 can be protected from contamination, or from being jarred out of position during the marketing process. The wrapping 8 can be easily removed in known manner whereupon the figurine 2 and the card 1 are ready for use as previously described.

Removal of the figurine 2 from association with the card 1 is accomplished easily by pushing or pulling the figurine 2 away from the plane of the card 1 and out of the cut away area 3 in either direction, by applying a force sufficient to overcome the frictional forces engaging the figurine 2 and the card 1. The figurine 2 may then be used in any manner desired separate from the card 1. The figurine 2 may be supported in a vertical orientation upon any suitable playing surface such as the floor or a table apart from the card, using the support base 7. In this manner, the figurine 2 becomes an independent element, separate from the card 1 in all respects.

The figurine 2 may easily be replaced within the card 1 as above mentioned for collection or storage by reinserting the figurine 2 within the cut out area 3 until frictional engagement occurs. Such removal and replacement is capable of being accomplished repeatedly as desired.

Utilizing a wrapping material 8 to enclose the card 1 and figurine 2 also permits a retailer to include additional novelty items or candy as part of the combination package. For example, trading cards of the type previously known have been extensively marketed in connection with bubble gum or other candy items. In the present invention, a stick of candy or gum 9 can easily be contained beneath the wrapping material 8.

It is to be understood that many variations of the configuration illustrated in the several drawings are possible. For example, the card 1 need not be rectangular. Such a shape is the preferred shape for trading cards. However, the use of other shapes would also be possible, for example round, elliptical, and polygonal configurations could be employed. Also, only one figurine 2 is illustrated for use in connection with a card 1. However, it will be appreciated that a plurality of figurines 2 may also be used in connection with a single card 1 and still fall within the meaning and intent of this invention.

It may therefore be seen that the above disclosed invention serves well to accomplish the objects previously stated. It may also be seen that the above described invention may be embodied in other specific forms in addition to those above disclosed and therefore the disclosure made should be interpreted in an illustrative and not a limiting sense.

What is claimed is:

1. A card suitable for removably retaining an object comprising a unitary planar card body having a front face and a rear face;

the card body being provided with a cut away area extending from the front face to the rear face, the cut away area being of configuration to frictionally engage and retain a peripherally configured, three dimensional object therein;

a peripherally configured, three dimensional object removably associated with the card body, the object being configured and adapted to be held within the cut away area of the card body by frictional engagement between at least a portion of the periphery of the object and at least a portion of the edge of the cut away area, a front portion of the object extending forwardly of the front face and a rear portion of the object extending rearwardly of the rear face;

a flexible wrapping enclosing completely the three dimensional object and at least a portion of the card body, the wrapping being in direct contact with the card body front face and rear face, the wrapping also being in direct contact with the front portion of the object and with the rear portion of the object, and a novelty item enclosed with the card body and the object by the wrapping, the said wrapping contacting directly the object;

whereby the object is removably retained within the card and is adapted for subsequent removal and reinsertion and whereby the novelty item is retained in association with the card in a protected manner to prevent contamination.

2. The card of claim 1 wherein the card body is completely enclosed by the flexible wrapping.

3. The card of claim 2 wherein the object comprises a base, said base having a flat bottom surface and being capable of supporting the object when removed from the card body to render the object free standing.

4. The card of claim 1 wherein the wrapping is flexible, transparent plastic.

5. The card of claim 1 wherein the novelty item is planar in configuration.

6. The card of claim 5 wherein the novelty item is chewing gum.

7. The card of claim 5 wherein the novelty item comprises a flat surface and wherein the flat surface is in substantially overall contact with one of said card body faces.

* * * * *